US005574336A

United States Patent [19]

Konopka et al.

[11] Patent Number: 5,574,336

[45] Date of Patent: Nov. 12, 1996

[54] FLOURESCENT LAMP CIRCUIT EMPLOYING A RESET TRANSISTOR COUPLED TO A START-UP CIRCUIT THAT IN TURN CONTROLS A CONTROL CIRCUIT

[75] Inventors: John G. Konopka, Barrington; Robert A. Priegnitz, Algonquin, both of Ill.

[73] Assignee: Motorola, Inc., Schaumburg, Ill.

[21] Appl. No.: 413,133

[22] Filed: Mar. 28, 1995

[51] Int. Cl.[6] ..... H05B 37/02

[52] U.S. Cl. ..... 315/225; 315/247; 315/307

[58] Field of Search ..... 315/225, 307, 315/247

[56] References Cited

U.S. PATENT DOCUMENTS

| | | | |
|---|---|---|---|
| 4,277,728 | 7/1981 | Stevens | 315/307 |
| 4,461,980 | 7/1984 | Nilssen | 315/225 |
| 4,667,131 | 5/1987 | Nilssen | 315/275 |
| 5,047,695 | 9/1991 | Allen et al. | 315/291 |
| 5,068,574 | 11/1991 | Koda et al. | 315/225 |
| 5,089,752 | 2/1992 | Pacholok | 315/225 |
| 5,436,529 | 7/1995 | Bobel | 315/127 |

*Primary Examiner*—Robert Pascal
*Assistant Examiner*—Michael Shingleton
*Attorney, Agent, or Firm*—J. Ray Wood

[57] ABSTRACT

A circuit for powering a fluorescent lamp has a direct current power supply (10). An inverter (12) is coupled to the direct current power supply (10) and provides a lamp current to the fluorescent lamp load (14). The inverter(12) is connected to an inverter control circuit (18). A protection circuit (16) for detecting lamp current is coupled to the inverter control circuit (18) such that the inverter control circuit (18) turns off the inverter (12) whenever the protection circuit detects the absence of lamp current.

9 Claims, 1 Drawing Sheet

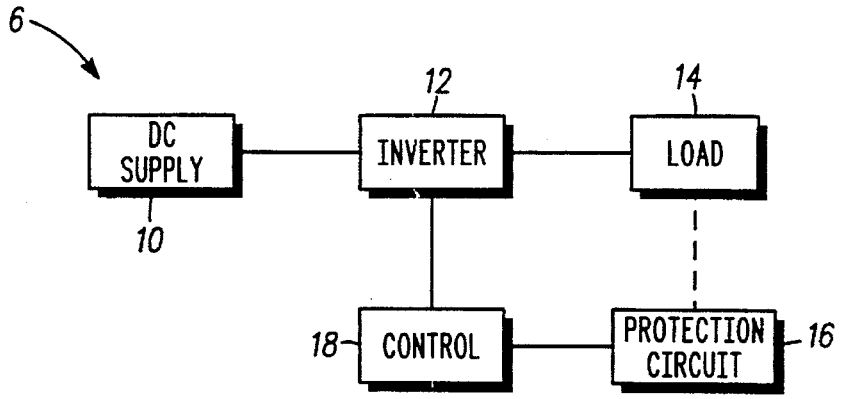
6
DC SUPPLY
10
INVERTER
12
LOAD
14
CONTROL
18
PROTECTION CIRCUIT
16
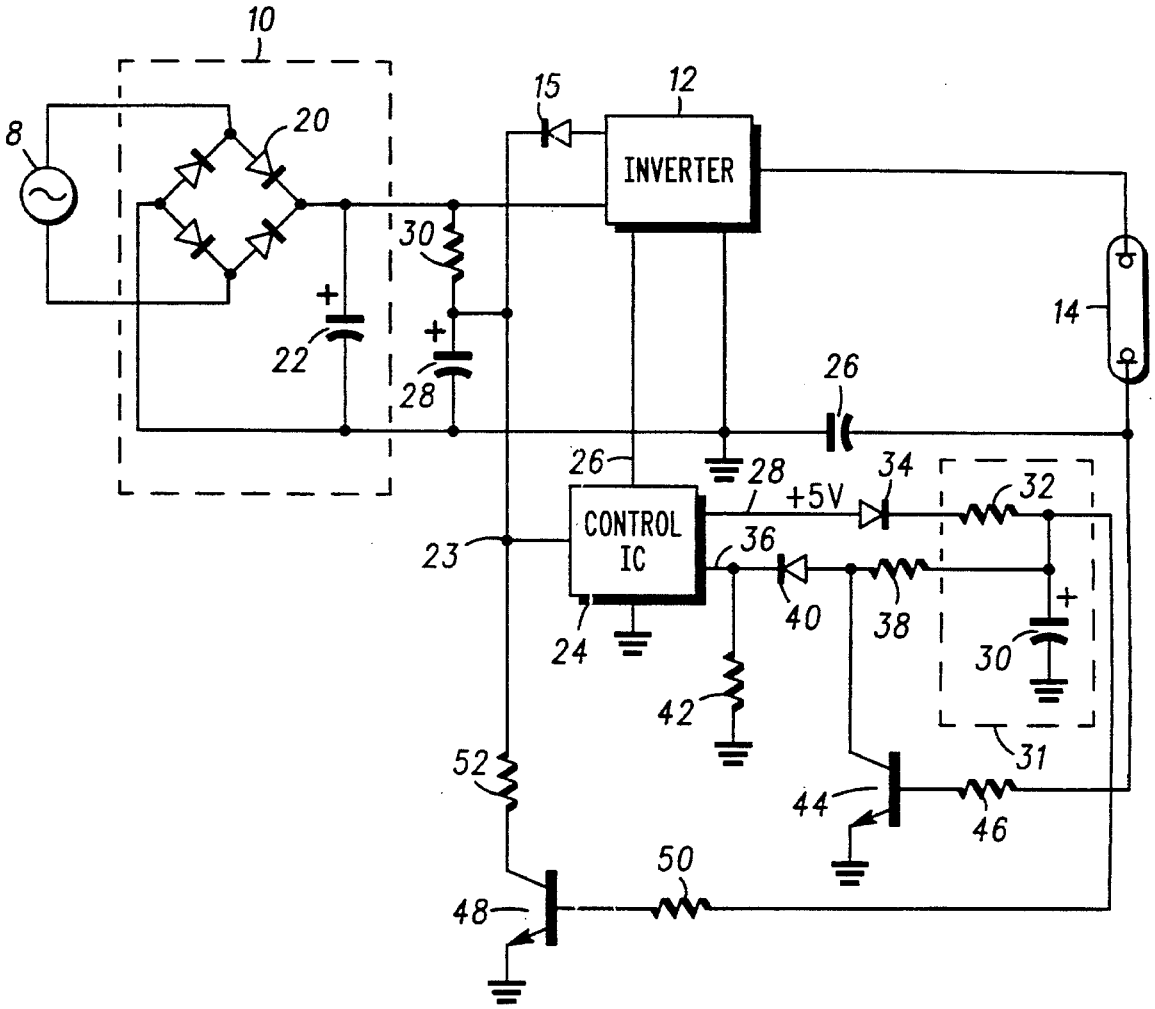
10
8
20
22
30
28
15
12
INVERTER
14
26
CONTROL IC
23
24
+5V
34
32
36
40
38
30
31
42
52
44
46
50
48

FLOURESCENT LAMP CIRCUIT EMPLOYING A RESET TRANSISTOR COUPLED TO A START-UP CIRCUIT THAT IN TURN CONTROLS A CONTROL CIRCUIT

FIELD OF THE INVENTION

This invention relates to electronic ballasts for powering fluorescent lamps.

BACKGROUND OF THE INVENTION

A lighting unit has an electronic ballast powering one or more fluorescent lamps. An electronic ballast cheaply and efficiently powers fluorescent lamps. In some types of lighting units, the fluorescent lamps are removable.

When a lamp fails, the lamp must be replaced. Usually, the power to the ballast is not turned off prior to replacement of the lamp. This causes several problems. First, present designs allow the ballast to consume large mounts of energy even if there is no lamp. Second, the voltage across the output terminals of the lamp presents a safety hazard to a person replacing the lamp.

A ballast that has reduced energy consumption when no lamp load is present, as well as reducing the shock risk to a person replacing the lamp, is thus highly desirable.

BRIEF DESCRIPTION OF THE DRAWINGS

FIG. 1 is a block diagram of a ballast in accordance with the invention.

FIG. 2 is a schematic diagram of the ballast made in accordance with the invention.

DETAILED DESCRIPTION OF THE DRAWINGS

The ballast of this invention uses a sensor to detect the presence of a fluorescent lamp. If a fluorescent lamp is not present or the lamp is not operating correctly, the inverter is disabled for a period of time. The inverter is then turned on for 8 milliseconds every two seconds in order to start the lamp. This reduces the power consumed by the ballast during those periods where a lamp is not attached to the ballast. Further, a person replacing the lamp is not at risk because the mount of voltage at the lamp terminals is pulsed rather than constant.

FIG. 1 shows a block diagram of a ballast 6 made in accordance with the invention. Direct current source (DC source)10 is coupled to and provides power to an inverter 12. Inverter 12 converts the power from the DC source 10 to high frequency AC (alternating current) power. The AC power is supplied to fluorescent lamp load 14. Fluorescent lamp load 14 is one or more fluorescent lamps.

Protection circuit 16 monitors load 14. Whenever there is a lamp out condition (i.e., a lamp is removed from the load), protection circuit 16 provides a signal to inverter control circuit 18. Inverter control circuit 18 then disables inverter 12.

FIG. 2 shows a schematic diagram of a ballast 6 made in accordance with the invention.

DC voltage source 10 is shown as a bridge rectifier 20 and electrolytic 22. DC source 10 could also be, for example, boost power supply or a battery.

DC voltage source 10 is coupled to inverter 12. The output of inverter 12 is coupled to fluorescent lamp load 14. Fluorescent lamp load 14 is shown as one fluorescent lamp, but it could be an array of series connected fluorescent lamps.

The output of inverter 12 is high frequency power having an AC (alternating current) component and a DC component. Typically, the output of inverter 12 is 35 kilohertz AC. The DC component of the output of inverter 12 is equal to the DC output of DC source 10. For a ballast 6 connected to 120 volt AC, the DC component would be about 166.7 volts.

Control IC (integrated circuit) 24 is a pulse width modulator that drives inverter 12. In the absence of a signal from control IC 25, inverter 12 will cease to operate. Control IC 24 has a shut down pin 36. When the voltage at IC shut down pin 36 exceeds 2.5 volts, the control IC 24 shuts down, thereby shutting down inverter 12.

DC blocking capacitor 26 is a low impedance path to ground for the high frequency AC lamp current.

When the DC source 10 is coupled to AC power source 8, startup capacitor 29 charges through resistor 33. When the voltage across capacitor 29 reaches approximately 16 volts, control IC 24 begins operating. A high frequency drive signal is produced on line 27. At the same, plus 5 volts DC appears at line 28. The voltage at line 28 charges a timing capacitor 30 through resistor 32 and diode 34. Resistor 32 and timing capacitor 30 form an RC (resistor-capacitor) time constant.

After startup, inverter 12 through diode 15 supplies 16 volts DC to control IC 24 to maintain the operation of control IC 24.

Timing capacitor 30 is connected to IC shut down pin 36 through a series combination of current limiting resistor 38 and blocking diode 40. Load resistor 42 is coupled between IC shut down pin 36 and ground. A shut down voltage will develop across load resistor 42, as described herein.

Resistor 32 and timing capacitor 30 form a timing circuit 31. The time constant of resistor 32 and timing capacitor 30 is such that the shut down voltage of 2.5 volts will develop across load resistor 42 in about 8 milliseconds. At that time, the control IC 24 will shut down, thereby shutting down inverter 12.

If sensing transistor 44 (shown as a bipolar junction transistor) is activated before 8 milliseconds has elapsed, no voltage will develop across load resistor 42, and thus control IC 24 will not shut down.

Resistor 46 is connected between the base of sensing transistor 44 and the junction of DC blocking capacitor 26 and lamp 14. Thus, if lamp 14 is present and operational, then a small mount of DC current will flow through the lamp 14 and through the base of the sensing transistor 44. The mount of DC current is controlled by the resistance of resistor 46.

The DC current thus turns on sensing transistor 44, causing the junction of resistor 38 and diode 40 to have a voltage of approximately ground potential. Thus, no current flows through resistor 42, and no voltage develops at IC shut down pin 36, and control IC 24 continues to operate.

The base of restart control transistor 48 is coupled through resistor 50 to timing capacitor 30 and timing resistor 32. As long as control IC 28 is operating, the restart control transistor 48 is on.

If lamp 14 falls to strike or if lamp 14 is removed, there will be no DC current flowing through resistor 46. Therefore, sensing transistor 44 will turn off, causing the voltage at the junction of resistor 38 and diode 40 to rise to a voltage above ground potential, thereby causing current to flow through resistor 42, thus turning off control IC 24, and thereby inverter 12. When inverter 12 turns off, no voltage is supplied to control IC 24 through diode 15.

After the control IC 24 turns off, control IC 24 no longer produces a voltage at line 28. Timing capacitor 30 begins to discharge through resistor 38 and 42 and also resistor 50. As long as there is a voltage greater than 0.6 volts across timing capacitor 30, restart control transistor 48 remains closed. The voltage at control IC startup pin 23 remains below 16 volts.

When the voltage across timing capacitor 30 falls below 0.6 volts, restart control transistor 48 turns off. The voltage at control IC startup pin 23 rises to 16 volts, and the control IC 24 restarts, causing the inverter 12 to start. The whole process then repeats.

A strike voltage of sufficient amplitude to strike the fluorescent lamp 14 will appear across the lamp terminals for a first predetermined period of time of about 8 milliseconds. The ballast 6 will periodically attempt to restart the lamp 14 for a second predetermined time of about two seconds. A strike voltage of sufficient amplitude to strike the fluorescent lamp 14 will appear across the lamp terminals for a period of about 8 milliseconds. Thus, the duty cycle of the inverter during a fault condition is less than 0.5% of the full input power. The average input power of the inverter during a fault condition is 0.3 watt.

Because of the low power consumption, the circuit easily meets Underwriter's Laboratory requirements for through the lamp leakage. This circuit has a minimum power consumption during fault modes and provides a safer environment for a person attempting to replace a failed lamp.

We claim:

1. A circuit for powering a fluorescent lamp comprising:

a direct current source;

an inverter coupled to the direct current source and providing a lamp current to the lamp;

an inverter control circuit;

a sensor for detecting lamp current, coupled to the inverter control circuit such that the inverter control circuit turns off the inverter whenever the sensor detects the absence of lamp current;

a DC voltage source which is present only when the inverter control circuit is operating;

a timing circuit coupled to the inverter control circuit and the DC voltage source; and a restart control transistor coupled to the timing circuit, the restart control transistor coupled to a startup circuit, the startup circuit starting the inverter control circuit such that the startup circuit is reactivated after a predetermined interval.

2. The circuit of claim 1 further comprising a direct current blocking capacitor coupled in series with the fluorescent lamp.

3. The circuit of claim 2 where the lamp current has a direct current component and an alternating current component.

4. The circuit of claim 3 where the sensor comprises a direct current limiting resistor and a sensing transistor coupled between the direct current blocking capacitor and circuit common.

5. The circuit of claim 4 where the timing circuit comprises a series combination of a first diode, a timing resistor and a timing capacitor.

6. The circuit of claim 5 further comprising a series combination of a resistor, a second diode and a load resistor, the junction of the load resistor and the second diode coupled so as to turn off the inverter control circuit.

7. The circuit of claim 5 where the restart control circuit is coupled to the startup circuit by way of a first voltage dividing resistor, the first voltage dividing resistor coupled to a second voltage dividing resistor.

8. The circuit of claim 6 where the restart control circuit is coupled to the startup circuit by way of a first voltage dividing resistor, the first voltage dividing resistor coupled to a second voltage dividing resistor.

9. The circuit of claim 8 further comprising a boot strap capacitor coupled between the junction of the first voltage dividing resistor and the second voltage dividing resistor.

* * * * *